United States Patent [19]

Imai et al.

[11] Patent Number: 5,028,582

[45] Date of Patent: Jul. 2, 1991

[54] RECEIVING SHEETS FOR DYE TRANSFER TYPE THERMAL PRINTING

[75] Inventors: Akihiro Imai, Ikoma; Tetsuji Kawakami; Hiromu Matsuda, both of Katano; Keiichi Yubakami, Suita; Nobuyoshi Taguchi, Ikoma, all of Japan

[73] Assignee: Matsushita Electric Industrial Co., Ltd., Osaka, Japan

[21] Appl. No.: 332,743

[22] Filed: Apr. 4, 1989

[30] Foreign Application Priority Data

| | | | |
|---|---|---|---|
| Apr. 7, 1988 | [JP] | Japan | 63-85893 |
| Jun. 10, 1988 | [JP] | Japan | 63-144241 |
| Dec. 13, 1988 | [JP] | Japan | 63-314056 |

[51] Int. Cl.[5] ..... B41M 5/035; B41M 5/26

[52] U.S. Cl. ..... 503/227; 8/471; 428/195; 428/423.1; 428/447; 428/480; 428/913; 428/914

[58] Field of Search ..... 8/471; 428/195, 447, 428/480, 913, 914, 423.1; 503/227

[56] References Cited

FOREIGN PATENT DOCUMENTS

| | | | |
|---|---|---|---|
| 76490 | 4/1983 | European Pat. Off. | 428/211 |
| 209359 | 1/1987 | European Pat. Off. | 503/227 |
| 0261970 | 3/1988 | European Pat. Off. | 503/227 |
| 1199997 | 9/1986 | Japan | 503/227 |
| 63-67190 | 3/1988 | Japan | 503/227 |
| 64-30793 | 2/1989 | Japan | 503/227 |
| 1202497 | 8/1989 | Japan | 503/227 |

*Primary Examiner*—Bruce H. Hess

*Attorney, Agent, or Firm*—Stevens, Davis, Miller & Mosher

[57] ABSTRACT

When a dyeable layer comprises cured product of at least one moisture-curable type resin, it can have a high image reliability, permit easy control of the printing sensitivity and serve for both low-speed printing and high-speed printing. A receiving sheet having a dyeable layer excellent in surface slipperiness which is useful for high-speed printing and/or relative-speeds printing, can be obtained when the dyeable layer comprises cured product of a moisture-curable type resin, or reaction cured product of a moisture-curable type resin with a reactive silicone oil.

8 Claims, 1 Drawing Sheet

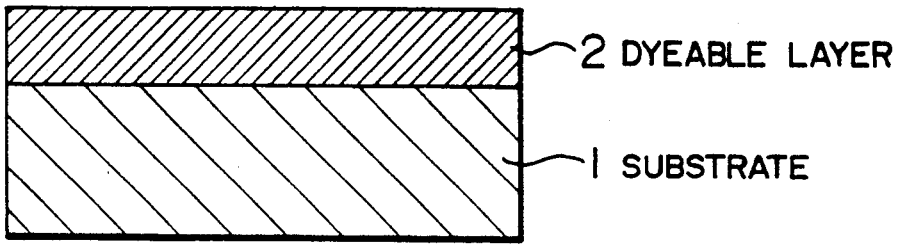
2 DYEABLE LAYER
1 SUBSTRATE

RECEIVING SHEETS FOR DYE TRANSFER TYPE THERMAL PRINTING

BACKGROUND OF THE INVENTION

1. Field of the Invention

This invention relates to receiving sheets used for dye transfer type thermal printing using a printing means, for example, a thermal head, an optical head for laser beam, etc., or a current-applied head. And it relates particularly to receiving sheets useful for high-speed printing and/or relative-speeds printing in which printing is conducted while controlling the relative speeds of a transfer sheet and a receiving sheet so as to make them different from each other.

2. Description of the Prior Art

In dye transfer type thermal printing, a sublimable dye on a transfer sheet is transferred to the dyeable layer of a receiving sheet to form an image. As resins constituting the dyeable layer of the receiving sheet used for the dye transfer type thermal printing, there are known various thermoplastic resins and various thermosetting resins [for example, Jap. Pat. Appln. Kokai (Laid-Open) Nos. 58-212994 and 60-25793]. In general, saturated polyester resins have a high dye-affinity and hence have been sufficiently investigated. When used alone, they involve a problem of their fusion to a transfer sheet (a color sheet). Therefore, it has been proposed to prevent the fusion by crosslinking such a high-dye-affinity resin by the use of an isocyanate or by incorporating the same with a reactive silicone oil [for example, Jap. Pat. Appln. Nos. 60-34898, 61-132387 and 63-19295].

Thermosetting resins which have a high heat resistance are useful for high-speed printing. Heretofore proposed radical- or ionic-polymerization resins undergo inhibition of curing, by oxygen, water or the like in the air during curing, resulting in formation of an uncured portion in the surface of a dyeable layer. The unreacted resin remains in the uncured portion and reacts with dyes and the like to lower the reliability. This problem is serious because an image is printed in the surface portion of the dyable layer. In addition, it is preferable to use resins having dye-affinity for both low-speed printing and high-speed printing by varying their heat resistance. However, in the case of various heretofore proposed resins, it is not easy to vary the heat resistance of their cured products widely while maintaining the above reliability. Thermosetting resins requiring a crosslinking agent such as isocyanate which becomes a constituent of their cured products, are disadvantageous in that since the degree of crosslinking of the cured product is closely related to the printing sensitivity, the degree of crosslinking should be controlled by adjusting the amount of the crosslinking agent. Relative-speeds printing requires a dyeable layer having an excellent surface slipperiness. As resins constituting the dyeable layer, resins capable of imparting properties such as excellent surface mold release properties and surface slipperiness are preferable. Heretofore proposed resins hardly impart such excellent properties, and no satisfactory resin has been proposed.

SUMMARY OF THE INVENTION

The present invention is intended to obtain a receiving sheet having the following advantages. The receiving sheet can serve for both low-speed printing and high-speed printing. Its dyeable layer has a high image reliability. The printing sensitivity can easily be controlled because there is used at least one resin requiring no crosslinking agent which becomes a constituent of cured product of the resin. Moreover, the receiving sheet is useful for high-speed printing and/or relative-speeds printing by virtue of a dyeable layer having an excellent surface slipperiness.

The receiving sheet of the present invention is used together with a transfer sheet having a sublimable dye-containing coloring material layer and comprises a substrate and a dyeable layer formed thereon and said dyeable layer contains a cured product obtained by crosslinking reaction betwen moisture curable resins having a hydrolyzable silyl group at the end of the molecule or in a side chain thereof, or a cured product obtained by crosslinking reacton between moisture-curable polyurethane resins having a hydrolyzable isocyanate group at the end of the molecule, or a reaction cured product of a moisture curable resin having a hydrolyzable silyl group at the end of the molecule or in a side chain thereof and a reactive silicone oil.

BRIEF DESCRIPTION OF THE DRAWINGS

The drawing is a sectional schematic illustration of the receiving sheet for dye transfer type thermal printing obtained in the examples of the present invention.

DETAILED DESCRIPTION OF THE INVENTION

In the drawing is shown a sectional schematic illustration of a receiving sheet for dye transfer type printing which is one example of the present invention.

A dyeable layer 2 is on a substrate 1. The substrate 1 is not critical. Particularly preferable examples of the substrate 1 include synthetic paper, white extruded films, transparent films, paper, laminated sheets of film and paper, and coated sheets obtained by coating an antistatic layer, an adhesive layer, etc.

Dyeable layer 2 contains a cured product obtained by crosslinking reaction between moisture-curable resins having a hydrolyzable silyl group at the end of the molecule or in a side chain thereof, or a cured product obtained by crosslinking reaction between moisture-curable polyurethane resins having a hydrolyzable isocyanate group at the end of the molecule, or a reacton cured product of a moisture-curable resin having a hydrolyzable silyl group at the end of the molecule or in a side chain thereof and a reactive silicone oil.

The moisture-curable resin having a hydrolyzable silyl group at the end of molecule or in the side chain is a silicon resin and does not contain reactive silicone component which is a polysiloxane having a hydrolyzable silyl grop. The moisture-curable resin of the present invention includes, for example, a vinyl polymer having a hydrolyzable silyl group at the end of the molecule or in the side chain with molecular weight of main component of main chain being 200–30,000, a polymer having a hydrolyzable silyl group at the end of molecule or in the side chain with the main chain having at least two ester structures, or a polymer having a hydrolyzable silyl group at the end of molecule or in the side chain with the main chain having at least two ether structures, a polymer having a hydrolyzable silyl group at the end of moelcule or in the side chain with the main chain having at least two amide structures, or the like.

Each of the moisture-curable resins of the present invention is synthesized in organic solution. A film is formed by coating a coating composition comprising at least a moisture-curable resin and an organic solvent on a substrate. When the moisture-curable type resins having a hydrolyzable silyl group at the end of the molecule or in the side chain have an ester, urethane, amide, ether or epoxy structure they are particularly useful because they have a high dye-affinity. Moisture-curable resins having a hydrolyzable silyl group at the end of the molecule or in the side chain which are obtained by synthesis or modification from (meth)acrylic acid and derivatives thereof, halogenated hydrocarbons, acrylonitrile, and cellulose and derivatives thereof also have the above characteristic. Since type resins are cross-linked by water in the air, they hardly leave unreacted resin in the surface of dyeable layer when reacted in an ordinary environment. In the case of type resins, having a hydrolyzable silyl group at the end of the molecule or in the side chain the heat resistance and printing sensitivity of the resins as dye-affinity possessing resins can be widely varied by using them alone or in combination with other resins because it is synthetically easy to introduce into their main chain various constitutive units, for example, hard segments of acryl, etc., and soft segments of urethane, olefin series hydrocarbons, etc. It is also easy to introduce thereinto fluorine (modified) compounds or silicone (modified) compounds by copolymerization in order to prevent fusion of the resins to a transfer sheet. The moisture-curable resins having a hydrolyzable silyl group at the end of the molecule or in the side chain react with reactive silicone oils having various functional groups such as silanol group, and hence make it possible to impart sufficient mold release properties and slipperiness, which are considered necessary for prevention of the fusion during high-speed printing and for relativerunnings printing, to the surface of dyeable layer stably. The reaction of a moisture-curable type resin having a hydrolyzable silyl group at the end of the molecule or in the side chain and a reactive silicone oil can be accelerated with the same (the same kind) curing accelerator (catalyst) for both of them, and therefore their reaction cured product can easily be produced. Furthermore, since the curing accelerator is not incorporated into the cured resin, it is easy to control the heat resistance and the dye-affinity on the basis of the structure of the resin before the reaction.

The hydrolyzable silyl group includes, for example, silyl groups formed by attachment to the silicon atom of a hydride group, halogen group, alkoxy group, acyloxy group, amino group, amide group, aminoxy group, alkenyloxy group, oxime group, thioalkoxy group, phenoxy group, or the like. Specific examples of the hydrolyzable silyl groups are given, for example, in Jap. Pat. Appln. Kokai (Laid-Open) No. 60-231722. A method for forming a hydrolyzable functional group is disclosed, for example, in Jap. Pat. Appln Kokai (Laid-Open) No. 54-123192.

Examples of moisture-curable type resin having the hydrolyzable silyl group at the end of molecule or in the side chain are given below:

(1) Urethane-vinyl type polymers composed of a copolymer of a vinyl monomer and a urethane prepolymer whose terminal NCO group is hindered by a vinyl compound having an active hydrogen and a silane coupling agent having an active hydrogen [Jap. Pat. Appln. Kokai (Laid-Open) No. 59-232110].

(2) Polyurethanes having vinyl groups and hydrolyzable silyl groups which are represented by the general formula shown below [Jap. Pat. Appln. Kokai (Laid-Open) No. 60-26022)]:

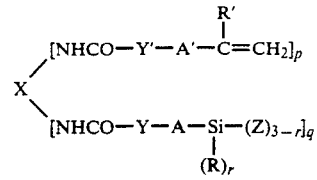

wherein X is a residue of urethane prepolymer X $(NCO)_{p+q}$ which has a molecular weight of 200 to 40,000; each of p and q is an integer of 1 or more which satisfies the formula $2 \leqq p+q \leqq 8$; r is 0, 1 or 2; each of Y and Y' is —O—, —S— or

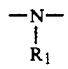

($R_1$ is H, or an alkyl or aryl group having 1 to 12 carbon atoms); R is an alkyl or aryl group having 1 to 12 carbon atoms; Z is a halogen, an alkoxy group, an acyloxy group, an amide group, an aminoxy group, an alkenyloxy group, an amino group, an oxime group or a thioalkoxy group; R' is H or an alkyl group having 1 to 12 carbon atoms; A is a residue of active-hydrogen-containing silane coupling agent

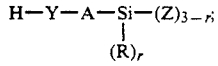

and A' is a residue of active-hydrogen-containing vinyl compound

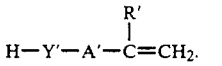

(3) Polyurethanes obtained by reacting (A) a NCO-terminated urethane prepolymer of a polymer polyol obtained from polyol and an ethylenic unsaturated monomer, with (B) a silane coupling agent having an active hydrogen [Jap. Pat. Appln. Kokai (Laid-Open) No. 61-133019].

(4) Silyl-group-containing NCO-terminated urethane prepolymers obtained by reacting an excess of a polyisocyanate either with a polymer polyol obtained by polymerizing an ethylenic unsaturated monomer having a hydrolyzable silyl group, alone or together with other ethylenic unsaturated monomers, in a polyol, or if necessary, with said polymer polyol and other active-hydrogen-containing compounds [Jap. Pat. Appln. Kokai (Laid-Open) No. 60-231722].

(5) Modified vinyl resins obtained by reacting an isocyanate organosilane with the hydroxyl groups of a hydroxyl-group-containing vinyl polymer comprising as constitutive units, (a) hydroxyl-group-containing monomer units, (b) (meth)acrylic acid derivative units and/or aromatic hydrocarbon vinyl monomer units, and if necessary, (c) other polymerizable monomer units, said polymer comprising 5 to 80% by weight of (a), 20 to 95% by weight of (b), and 0 to 20% by weight of (c) [Jap. Pat. Appln. Kokai (Laid-Open) No. 61-106607].

(6) Modified polyurethanes obtained by reacting a polymer polyol obtained from polyol and an ethylenic unsaturated monomer, an organopolyisocyanate, and an isocyanate organosilane with one another [Jap. Pat. Appln. Kokai (Laid-Open) No. 61-200116].

(7) The moisture-curable type resins having a hydrolyzable silyl group at the end of molecule or in the side chain which are disclosed in Jap. Pat. Pub. No. 46-30711, and urethane polymers represented by the general formula:

$$(RO)_3Si-R'-Z-\overset{\overset{\displaystyle O}{\|}}{C}-\overset{\overset{\displaystyle H}{|}}{N}-[\text{polyurethane residue}]-\overset{\overset{\displaystyle H}{|}}{N}-\overset{\overset{\displaystyle O}{\|}}{C}-Z-R'-Si(OR)_3$$

wherein R is an alkyl group, R' is a divalent hydrocarbon group, and Z is —S— or —NR (R is hydrogen or an alkyl group [Jap. Pat. Appln. Kokai (Laid-Open) No. 51-73561].

(8) Moisture-curable type silicon-terminated polyurethane polymers obtained by reacting a polyurethane prepolymer having a terminal active hydrogen atom with an isocyanate orgahosilane having a terminal isocyanate group and at least one hydrolyzable alkoxy group bonded to silicon [Jap. Pat. Appln. Kokai (Laid-Open) No. 58-29818].

(9) The moisture-curable type resins disclosed in Jap. Pat. Pub. No. 46-12154, for example, polyether type polymers represented by the general formula:

$$(RO)_{3-a}\overset{\overset{\displaystyle Ra}{|}}{Si}-CH_2CH_2CH_3O-[\text{polyoxyalkylene}]-OCH_2CH_2CH_2-\overset{\overset{\displaystyle Ra}{|}}{Si}-(OR)_{3-a}$$

wherein R is an alkyl group, and a is an integer of 0 to 2.

(10) Vinyl resins having at least one silyl group in the molecule which are represented by the formula:

$$X_{(3-a)}\overset{\overset{\displaystyle (R_1)_a}{|}}{Si}-\underset{\underset{\displaystyle R_2}{|}}{CH}-$$

wherein each of $R_1$ and $R_2$ is hydrogen or a monovalent group selected from the group consisting of alkyl groups, aryl groups and aralkyl groups all of which have 1 to 10 carbon atoms; X is a group selected from the group consisting of halogens, alkoxy groups, acyloxy groups, aminoxy group, phenoxy group, thioalkoxy groups and amino group; a is an integer of 0 to 2 [Jap. Pat. Appln. Kokai (Laid-Open) Nos. 54-36395 and 54-123192]. Among the vinyl resins, particularly preferable are those which comprise as their constituent or main constituent a homopolymer or copolymer of one or more members selected from the group consisting of (meth)acrylic acid and derivatives thereof (e.g. methyl acrylate, methyl methacrylate, butyl acrylate, butyl methacrylate, and acrylonitrile), styrene, α-methylstyrene, alkyl vinyl ethers, vinyl chloride, vinyl acetate, vinyl propionate, and ethylene.

As the moisture-curable polyurethane resin having at least a hydrolyzable isocyanate group at the end of molecule, there can be exemplified, for example, NCO-terminated polyurethanes produced by the reaction of a compound containing two or more active hydrogens (e.g. polypropylene glycol) with an organopolyisocyanate (e.g. tolylene diisocyanate). There can be used, for example, the resins disclosed in Jap. Pat. Appln. Kokai (Laid-Open) Nos. 57-147511, 57-94056, and 60-231722.

Among the moisture-curable type resins, the following resins are particularly useful. Acryl silicon resins give a highly heat-resistant dyeable layer and hence can serve particularly for high-speed printing. Urethane silicon resins are excellent in dye-affinity and light resistance and hence can be used for forming a dyeable layer having a high printing sensitivity and a high light resistance. Acryl urethane silicon resins give a dyeable layer which have a high printing sensitivity and can serve for high-speed printing, because their compositions can be chosen in a wide range.

Fluorine-containing moisture-curable type resins obtained by introducing fluorine into the moisture-curable type resins described above are particularly useful because they have a very excellent preventing effect on the fusion to a sheet. Even when a moisture-curable type resin having a molecular structure which permits thermally easy softening is used in order to increase the dyeing sensitivity, it is not fused to a color sheet at all when used together with the fluorine-containing moisture-curable type resin.

Among the fluorine-containing moisture-curable type resins, those having a perfluoroalkyl group in the molecule are markedly effective.

As the ratio of the average molecular weight of the fluorine-containing moisture-curable type resin to the total atomic weight of the fluorine atoms contained, a ratio in the range of 5,000:1 to 100:20 can be employed in general. In particular, the fluorine-containing moisture-curable type resins disclosed in Jap. Pat. Appln. Kokai (Laid-Open) No. 62-558 are useful.

Silicone-containing moisture-curable type resins obtained by introducing a silicone into the moisture-curable type resins described above are useful because they impart slipperiness to the surface of dyeable layer. Silicones can be introduced into the resins by using various reactive silicone oils, reactive siloxane oligomers and the like which are obtained by modification with, for example, SiH, silanol, alkoxy compounds, alcohols, carboxyl compounds, epoxy compounds, vinyl compounds, and allyl compounds.

Moisture-curable type resins modified with both fluorine and silicone can be advantageously used. The average molecular weight of the moisture-curable type resin used in the present invention is usually 500 to 100,000, preferably 1,000 to 50,000.

Various reactive silicone oils which react with the hydrolyzable functional groups of the moisture-curable type resins can be used for giving surface mold release properties or slipperiness to the dyeable layer or for improving them further. The reactive silicone oils includes, for example, various modified silicone oils obtained by modification with SiH, silanol, alkoxy compounds, alcohols, carboxyl compounds, epoxy compounds, etc. It is also possible to introduce various functional groups such as epoxy, hydroxy, etc. into the moisture-curable type resins and use reactive silicone oils which react with these functional groups. In addition, it is also possible to use, as additives, various silicone oils, various modified silicone oils, various coupling agents of silane series, titanate series, aluminum series and the like, etc. As described above, reaction curred products of the moisture-curable type resins with the various reactive silicone oils are very effective in preventing the fusion to a color sheet and in imparting slipperiness to the dyeable layer.

In curing the moisture-curable type resin alone or together with a reactive silicone, it is preferable to use a curing accelerator (a curing catalyst). As the curing accelerator, there can be used titanates, amines organotin compounds, acidic compounds, etc., for example, alkyl titanates, metal salts of carboxylic acids, such as tin octylate, dibutyltin dilaurate, dibutyltin maleate and the like, amine salts such as dibutylamine 2-hexoate and the like, and the curing catalysts disclosed in Jap. Pat. Appln. Kokai (Laid-Open) Nos. 58-19361, 60-51724 and 60-13850. The adding amount of the curing accelerator is usually 0.001 to 20% by weight based on the weight of the resin.

When the moisture-curable type resin alone, or said resin and the reactive silicone are used in the form of a coating material or the like, a storage stabilizer is included in the coating material if necessary. The storage stabilizer includes, for example, the stabilizers disclosed in Jap. Pat. Appln. Kokai (Laid-Open) 60-51724 and 57-147511, etc.

The dyeable layer may contain various macromolecular materials other than the moisture-curable type resin. As the various macromolecular materials, macromolecules having an excellent dye-affinity for disperse dyes are preferable. There can be used, for example, polyester resins, epoxy resins, urethane resins, acrylic resins, cellulose acetate resins, polyvinyl acetal resins, etc. A high printing sensitivity can be attained particularly when these resins are used in combination with saturated polyester resins, urethane resins, polyvinyl acetal resins, styrene resins, vinyl acetate resins, etc. The various macromolecular materials can be added in an amount of more than 10 times weight (in terms of solids) as much as the moisture-curable type resin.

The dyeable layer may contain various additives such as particles, lubricants, surfactants, antistatic agents, ultraviolet absorbers, antioxidants, etc. One or more suitable intermediate layers such as bonding layer, release layer, etc. may be formed between the substrate and the dyeable layer. Particularly when a bonding layer is formed on the substrate, the adherence of the substrate and the dyeable layer is good. Specific examples of the present invention are described below.

EXAMPLE 1

A white polyethylene terephthalate (PET) film (U-12, mfd. by Teijin Ltd.; thickness 100 μm) was used as a substrate. One side of the substrate was coated with a coating material consisting of 10 parts by weight of a polyester-based adhesive (STAFIX, SOC-30-M, mfd. by FUJI PHOTO FILM CO., LTD.), 0.39 parts by weight of a poly-isocyanate solution (Coronate L mfd. by NIPPON POLYURETHANE INDUSTRY CO., LTD.), 70 parts by weight of toluene and 70 parts by weight of 2-butanone, to form an anchor coat layer of about 0.1 μm in thickness. Then, by means of a wire bar, the anchor coat layer was coated with a coating material consisting of 10 parts by weight of an acryl urethane silicon resin solution (UA-46, mfd. by SANYO CHEMICAL INDUSTRIES, LTD.; active ingredient 57%, acryl/urethane ratio=about 3/7), 0.3 part by weight of a fluorine-containing acryl silicon resin solution (F-2A, mfd. by SANYO CHEMICAL INDUSTRIES, LTD.; active ingredient 48% by weight), 0.3 part by weight of a catalyst (Cat. FX, mfd. by SANYO CHEMICAL INDUSTRIES, LTD.) and 10 parts by weight of toluene. Thereafter, the thus coated substrate was subjected to curing reaction in an oven at 100° C. for about 1 hour to form a receiving sheet having a dyeable layer of about 5 μm in thickness.

Next, ink consisting of 2.5 parts by weight of cyan dye of the structural formula shown below, 4 parts by weight of styrene-acrylonitrile copolymer, 50 parts by weight of toluene and 50 parts by weight of 2-butanone, was coated by means of a wire bar on the anchor coat layer of a polyethylene terephthalate film (thickness: 6 μm) having a slippery heat-resistant layer on the under surface and an isocyanate-crosslinked saturated polyester resin layer (the anchor coat layer) of about 0.1 μm in thickness on the top surface, whereby a transfer sheet having a coloring material layer of about 1 μm in thickness was produced.

The receiving sheet and the transfer sheet were held between a thermal head and a platen and pressed together at a pressure of about 4 kg, and printing was conducted under the following conditions:

Printing speed: 33.3 ms/line

Printing energy: 6 J/cm$^2$

Consequently, a printing density of 1.70 was attained and the dyeable layer was not fused to the transfer sheet at all.

Subsequently, the printed image was allowed to stand in a thermo-hygrostat chamber at 60° C. and 60% RH for 300 hours, but the density of the printed image was not lowered at all.

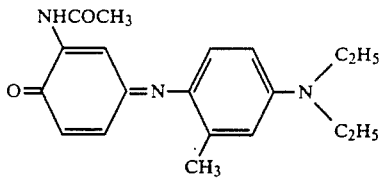

EXAMPLE 2

In the same manner as in Example 1, the same substrate subjected to the anchor coat treatment as in Example 1 was coated by means of a wire bar with a coating material consisting of 10 parts by weight of an acryl silicon resin solution (UA-01, mfd. by SANYO CHEMICAL INDUSTRIES, LTD.; active ingredient 52% by weight), 0.3 part by weight of fluorine-containing acryl silicon resin solution (F-2A), 0.3 part by weight of catalyst (Cat. FX) and 10 parts by weight of toluene, whereby a receiving sheet having a dyeable layer of about 5 μm in thickness was produced.

This receiving sheet and the same transfer sheet as in Example 1 were held between a thermal head and a platen and pressed together at a pressure of about 4 kg, and printing was conducted under the following conditions:

Printing speed: 16.7 ms/line

Printing energy: 6 J/cm$^2$

Consequently, a printing density of 1.55 was attained and the dyable layer was not fused to the transfer sheet at all.

Then, the printed image was allowed to stand in a thermo-hygrostat chamber at 60° C. and 60% RH for 300 hours, but the density of the printed image was not lowered at all.

EXAMPLE 3

A receiving sheet was produced by forming a dyeable layer of about 5 μm in thickness on the same substrate subjected to the anchor coat treatment as in Example 1 in the same manner as in Example 1, except for using a coating material consisting of 4 parts by weight of a saturated polyester resin (VYLON, RV-220, mfd. by TOYOBO CO., LTD., Japan), 11 parts by weight of acryl urethane silicon resin solution (UA-46), 0.3 part by weight of fluorine-containing acryl silicon resin solution (F-2A), 0.33 part by weight of catalyst (Cat, FX), 5 parts by weight of toluene and 5 parts by weight of 2-butanone. Thereafter, printing was conducted in the same manner as in Example 2. Consequently, a printing density of 1.77 was attained and the dyeable layer was not fused to the transfer sheet at all. Then, the printed image was stored under conditions of 60° C. and 60% RH for 300 hours, but no lowering of the printing density occurred at all.

EXAMPLE 4

A receiving sheet was produced by forming a dyeable layer of about 5 μm in thickness on the same substrate subjected to the anchor coat treatment as in Example 1 in the same manner as in Example 1, except for using a coating material consisting of 6 parts by weight of saturated polyester resin (VYLON, RV-220), 11 parts by weight of an acryl urethane silicon resin solution (UA-53, mfd. by SANYO CHEMICAL INDUSTRIES, LTD.; active ingredient 49% by weight, acryl/urethane ratio=about 6/4), 0.5 part by weight of a dimethyl-siloxane containing acryl silicon resin solution (F-6A, mfd. by SANYO CHEMICAL INDUSTRIES, LTD.; active ingredient 54% by weight), 0.33 part by weight of catalyst (Cat, FX), 5 parts by weight of toluene and 5 parts by weight of 2-butanone. Thereafter, printing was conducted in the same manner as in Example 2. Consequently, a printing density of 1.72 was attained and the dyable layer was not fused to the transfer sheet at all. Then, the printed image was stored under conditions of 60° C. and 60% RH for 300 hours, but no lowering of the printing density occurred at all.

EXAMPLE 5

A receiving sheet was produced by forming a dyeable layer of about 3 μm in thickness on the same substrate subjected to the anchor coat treatment as in Example 1 in the same manner as in Example 1, except for using a coating material consisting of 20 parts by weight of acryl urethane silicon resin solution (UA-53), 0.6 part by weight of fluorine-containing acryl silicone resin solution (F-2A), 0.5 part by weight of a SiH-modified silicone oil (FZ-3702, mfd. by NIPPON UNICAR CO., LTD.), 0.5 part by weight of dimethyl-siloxane-containing acryl silicon resin solution (F-6A), 0.3 part by weight of a catalyst (dibutyltin dilaurate) and 20 parts by weight of toluene.

Next, a transfer sheet having a coloring material layer of about 1 μm in thickness was produced by coating a carbon-containing electrically conductive aramide film (thickness: 10 μm) by means of a wire bar with ink consisting of 6 parts by weight of cyan dye of the above structural formula, 4 parts by weight of polycarbonate, 0.24 part by weight of amide-modified silicone oil (KF-3935), 0.4 part by weight of titanium oxide and 100 parts by weight of toluene. The receiving sheet and the transfer sheet were held between a currentapplied stylus head and a platen and pressed together at a pressure of about 3 kg, and printing was conducted at a ratio of the running speed of the transfer sheet to that of the receiving sheet of 1:5 under the following conditions:

Printing speed: 16.7 ms/line

Printing energy: 6 J/cm$^2$

Consequently, a printing density of 1.50 was attained, the dyeable layer was not fused to the transfer sheet at all, and the relation between runnings of the transfer sheet and the receiving sheet was stable.

EXAMPLE 6

A receiving sheet was produced by forming a dyeable layer of about 5 μm in thickness on the same substrate subjected to the anchor coat treatment as in Example 1 in the same manner as in Example 1, except for using a coating material consisting of 12 parts by weight of an acryl urethane silicon resin solution (UA-40, mfd. by SANYO CHEMICAL INDUSTRIES, LTD.; active ingredient 50% by weight, acryl/urethane ratio=about 7/3), 2 parts by weight of a polyvinyl butyral (BX-1, mfd. by SEKISUI CHEMICAL CO., LTD.), 1,2-parts by weight of dimethyl-siloxane-containing acryl silicon resin solution (F-6A), 0.16 part by weight of a catalyst (dibutyltin dilaurate), 5 parts by weight of toluene and 15 parts by weight of 2-butanone.

Using the same transfer sheet as in Example 5, the receiving sheet was evaluated under the same printing conditions as in Example 5. Consequently, a printing density of 1.56 was attained, the dyeable layer was not fused to the transfer sheet, and the relation between runnings of the transfer sheet and the receiving sheet was stable.

EXAMPLE 7

A receiving sheet was produced by forming a dyeable layer of about 5 μm in thickness on the same substrate subjected to the anchor coat treatment as in Example 1 in the same manner as in Example 1, except for using a coating material consisting of 12 parts by weight of acryl silicon resin solution (UA-01), 4 parts by weight of saturated polyester resin (VYLON, RV-220), 1 part by weight of talc (#5000PJ mfd. by MATSUMURA SANGYO COMPANY, LTD.), 1.8 parts by weight of dimethyl-siloxane-containing acryl silicon resin solution (F-6A), 0.4 part by weight of fluorine-containing acryl silicone resin solution (F-2A), 0.16 part by weight of a catalyst (dibutyltin dilaurate), 10 parts by weight of toluene and 10 parts by weight of 2-butanone.

The receiving sheet and the same transfer sheet as in Example 5 were held between a current-applied stylus head and a platen and pressed together at a pressure of about 3 kg, and printing was conducted as a ratio of the running speed of the transfer sheet to that of the receiving sheet of 1:5 under the following conditions:

Printing speed: 4.2 ms/line

Printing energy: 6 J/cm$^2$

Consequently, a printing density of 1.52 was attained, the dyeable layer was not fused to the transfer sheet at all, and the relation between the runnings of the transfer sheet and the receiving sheet was stable.

COMPARATIVE EXAMPLE 1

A coating material consisting of 30 parts by weight of a radical-polymerization resin (SP-5003, mfd. by SHOWA HIGH POLYMER CO., LTD.), 1.5 parts by weight of IRGACURE 184 [CIBA-GEIGY (JAPAN) LTD.] and 80 parts by weight of 2-butanone, was coated on the same substrate as in Example 1 by means of a wire bar, dried and then irradiated with light from a high-pressure mercury arc lamp under nitrogen to be cured, whereby a dyeable layer of about 5 μm in thickness was formed.

Using the receiving sheet thus obtained and the transfer sheet produced in Example 1, printing was conducted under the same printing conditions as in Example 1. Consequently, a printing density of 1.42 was attained. After the printed image was stored under conditions of 60° C. and 60% RH for 300 hours, the printing density was about 8% lower than its initial value.

COMPARATIVE EXMAPLE 2

A coating material consisting of 40 parts by weight of an ionic-polymerization resin (ERL-4299, mfd. by UNION CARBIDE CORPORATION), 2 parts by weight of a UV curing initiator (SP-150, mfd. by ASAHI DENKA KOGYO K.K.) and 20 parts by weight of 2-butanone, was coated on the same substrate as in Example 1 by means of a wire bar, dried, and then irradiated with light from a highpressure mercury arc lamp to be cured, whereby a dyeable layer of about 5 μm in thickness was formed.

Using the receiving sheet thus obtained and the transfer sheet produced in Example 1, printing was conducted under the same printing conditions as in Example 1. Consequently, a printing density of 0.98 was attained. After the printed image was stored under conditions of 60° C. and 60% RH for 300 hours, the printing density was about 13% lower than its initial value.

What is claimed is:

1. A dye transfer type thermal printing system which comprises a receiving sheet, which consists of a substrate and a dyeable layer formed thereon, and a transfer sheet having a sublimable dye-containing coloring material layer, said dyeable layer contianing a cured product obtained by crosslinking reaction between moisture-curable resins having a hydrolyzable silyl group at the end of molecule or in the side chain.

2. A dye transfer type thermal printing system which comprises a receiving sheet, which consists of a substrate and a dyeable layer formed thereon, and a transfer sheet having a sublimable dye-containing coloring material layer, said dyeable layer containing a cured product obtained by crosslinking reaction between moisture-curable polyurethane resins having a hydrolyzable isocyanate group at the end of molecule.

3. A dye transfer type thermal printing system which comprises a receiving sheet, which consists of a substrate and a dyeable layer formed thereon, and a transfer sheet having a sublimable dye-containing coloring material layer, said dyeable layer containing a reaction cured product of moisture-curable resin having a hydrolyzable silyl group at the end of the molecule or in the side chain and a reactive silicone oil.

4. A dye transfer type thermal printing system according to claims or 3, wherein the moisture-curable resin is at least one resin selected from the group consisting of fluorine-containing moisture-curable resin and silicone-containing moisture-curable resin.

5. A dye transfer type thermal printing system according to claims 1 or 3, wherein the moisture-curable resin is at least one resin selected from the group consisting of moisture-curable acryl silicon resin and mooisture-curable urethane silicon resin.

6. A dye transfer type thermal printing system according toc laims 1 or 3, wherein the moisture-curable resin is a combination of at least one resin selected from the group consisting of moisture-curable acryl silicon resin and moisture-curable urethane silicon resin and at least one resin selected form the group consisting of fluorine-containing moisture-curable resin and silicone-containing moisture-curable resin.

7. A dye transfer type thermal printing system according to any oen of claims 1, 2 or 3, wherein the dyeable layer contains a thermoplastic resin.

8. A dye transfer type thermal printing system according to any one of claims 1, 2 or 3, wherein the dyeable layer contains a saturated polyester resin.

* * * * *